United States Patent [19]

Tesan

[11] 4,098,219

[45] Jul. 4, 1978

[54] SKI PROPULSION PADDLES

[76] Inventor: Riccardo Tesan, 2397 Finch Ave. W., Weston, Canada

[21] Appl. No.: 747,664

[22] Filed: Dec. 6, 1976

[51] Int. Cl.[2] ..... B63H 1/32

[52] U.S. Cl. ..... 115/31; 115/24.1

[58] Field of Search ..... 416/64–69; 9/1.1, 310 R, 310 A, 310 B, 310 D, 310 E, 400; 114/270; 115/21, 22, 22.1, 24.1, 31

[56] References Cited

U.S. PATENT DOCUMENTS

| | | | |
|---|---|---|---|
| 2,599,791 | 6/1952 | Swenson | 115/31 |
| 3,677,216 | 7/1972 | Gentemann | 115/24.1 |
| 3,800,734 | 4/1974 | Whang | 115/31 |
| 3,830,189 | 8/1974 | Yamanaka | 115/31 |

*Primary Examiner*—Trygve M. Blix
*Assistant Examiner*—D. W. Keen

[57] ABSTRACT

Manually operable propulsion paddles, for use in water skiing or boating are provided with a lower water-engaging portion, an upwardly-extending shaft and a handle at the upper portion of the shaft. The water engaging portion comprises a pair of plates hingedly secured on a hinge pin mounted on the lower portion of the shaft. The plate members assume an open position when downward force is exerted on them, for propulsion through the water, and a closed position for easy withdrawal through the water.

4 Claims, 3 Drawing Figures

SKI PROPULSION PADDLES

FIELD OF THE INVENTION

This invention relates to manually operable propulsion poles or paddles, for use with water skis or boats for self-propulsion.

BACKGROUND OF THE INVENTION

Water skis of the type which an operator attaches one to each foot and propels himself along by means of hand held paddles which are pushed against the water have been proposed in the past. The operation of previously proposed water skis and paddles, however, has required considerable agility and athletic ability on the part of the operator. They have required strenuous and energetic effort to operate, particularly for extended periods of time. This strenuous effort, coupled with problems of maintaining balance on the skis during the expenditure of such effort, has limited the appeal of this form of recreation.

BRIEF DESCRIPTION OF THE PRIOR ART

Various forms of self-propelled water skis and propulsion paddles therefor have been described in the prior art. In U.S. Pat. No. 3,027,576 Fines, for example, paddles are shown having a shaft and a buoyant watertight tank or cover secured to the bottom end of the pole, and having an open end of the tank or cover presented downwardly to the water. This same patent also proposes an umbrella-like form of cup or tank which collapses on upward movement through the water to facilitate withdrawal of the paddle from the water. U.S. Pat. No. 3,800,734 Whang, shows water propulsion paddles having valve arrangements in the lower, water engaging formation to facilitate water engagement on downward strokes and easy removal through the water on upward strokes. U.S. Pat. No. 3,313,265 Gain shows a paddle having an open ended lower elastic cup of elastic material. The prior art devices generally show lower water engaging means which entrap air therein and carry it below the surface of the water on a propulsion stroke. This gives a degree of buoyancy to the lower ends of the paddles which makes them difficult to control. To provide valves for release of this air increases the cost of manufacture. The use of flexible rubber, plastic or textile materials is undesirable because of increased resistance on withdrawal through the water, and because of the risk that such flexible constructions such as umbrella-like construction may not open on downward thrust.

SUMMARY OF THE INVENTION

The present invention has as an object the provision of improved paddles or poles for use in combination with water skis, boats or the like for self propulsion.

A further object is to provide water ski paddles which are simple and easy to operate and manufacture.

Other objects and advantages will become apparent from the following description.

Briefly, the present invention provides a water ski propulsion paddle of the above type which includes a lower water-engaging portion, and a handle means at the upper portion of the shaft, the water engaging means comprising at least one plate member hingedly mounted relative to the shaft, for hinging movement between an open position in which said plate member lies in a plane generally transverse to the longitudinal axis of the shaft, and a closed position in which the plate member lies in a plane making an angle of less than 45° to the longitudinal axis of the shaft.

In the arrangement according to the present invention the paddle presents a large bottom surface area for pushing against the water during the downward propulsion stroke, but collapses to its closed position due to the water resistance on upward withdrawal through the water on the return stroke, to facilitate return movement of the paddle. This reduces the overall effort which the operator has to expend in operating the water skis and paddles, rendering such operation less tiring and assisting the operator in maintaining balance on the water skis during operation.

DESCRIPTION OF THE PREFERRED EMBODIMENTS

Preferably, the water engaging portion of the paddle is provided with two hingedly mounted plates in opposed relationship, hingedly mounted on either side of a transversely extending hinge pin secured to the lower part of the shaft. Biasing means are also preferably provided, which urge the two plates towards their closed position.

It is preferred to have the two plates open to form an angle of about 130°–170° between themselves in the open position rather than fully open to a 180° angle. Better thrust against the water is achieved in this manner since the water can exert a reaction force directly under the end of the poles by arranging for such an angle to be left.

Similarly in the closed position, it is preferred that the plates do not close together completely, but leave a small angle of 10°–30° between them, to ensure that they open properly on the next downward thrust.

The paddles according to the present invention may also include arm supporting means, attached to the upper end of the shaft, as described in my copending application Ser. No. 747,666, filed on even date herewith.

BRIEF REFERENCE TO THE DRAWINGS

In the drawings, like reference numerals indicate like parts.

DETAILED DESCRIPTION OF THE SPECIFIC PREFERRED EMBODIMENTS

Figure 1:
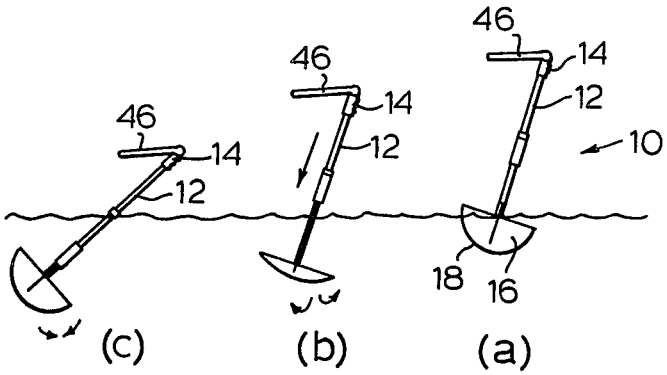
FIG. 1 is a diagrammatic illustration of the operation of a water ski paddle according to the invention, showing the disposition of the paddle at various stages of operation.
Figure 2:
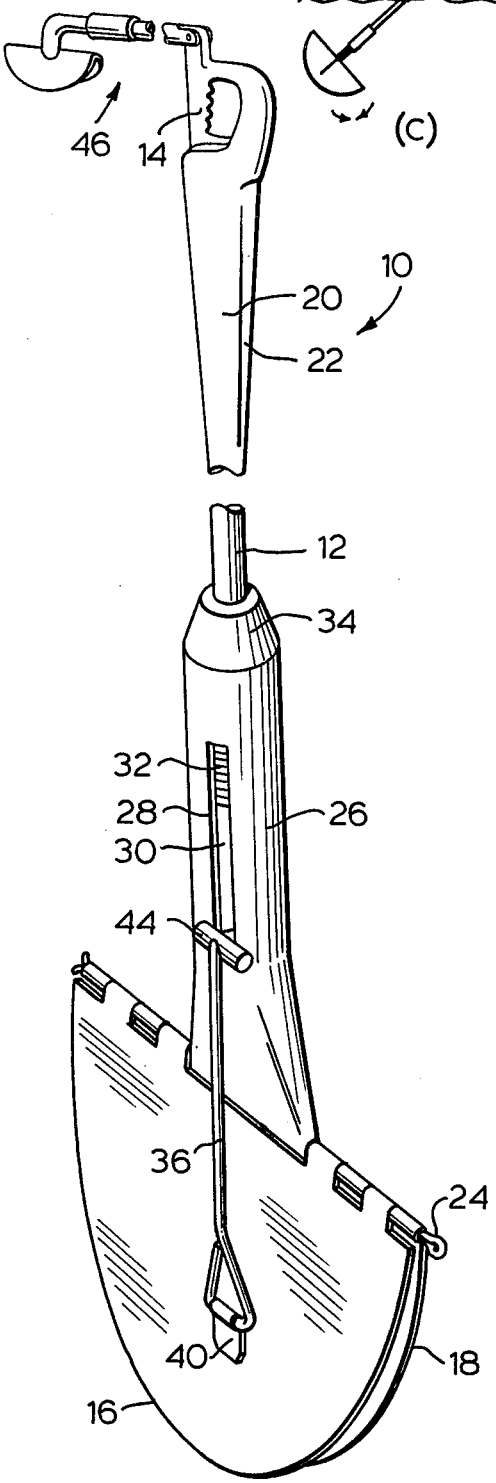
FIG. 2 is a perspective view of a paddle of FIG. 1, in the closed position.

With reference to FIG. 1, as the paddle 10 enters the water for a propulsion stroke, the shaft portion 12 thereof is disposed at an acute angle to the water, as shown at (*a*). The upper end of the shaft 12 is provided with a handle 14 in the form of an apertured formation which the operator can grip (FIG. 2). The lower end of the paddle 10 is provided with a pair of hinged plates 16, 18, which form a lower water-engaging portion, hingedly movable between a first closed position, to which they are biased, shown in FIG. 1 (*a*), and a second, open position shown in FIG. 1 (*b*), in which the plates 16, 18 are disposed at an angle of about 150° to one another. During a propulsion stroke, the operator exerts downward force on the paddle 10 and the plates open to increase the thrust against the water. Then the paddle 10 assumes the position shown in FIG. 1 (*b*).

At the end of the propulsion stroke, the shaft 12 of the paddle 10 assumes an angle as shown in FIG. 1 (*c*), i.e. more horizontal with respect to the water surface, and has moved upwardly with respect to the operator's arm. As the operator attempts to lift the paddle 10 out of the water at the end of the propulsion stroke, with forward movement through the water, the plates 16, 18 close against the water resistance and under the urging of their biasing. The plates 16, 18 do not close completely, so as to be sure that the water resistance will cause them to open on the next propulsion stroke. At the open position, the plates 16, 18 form an angle of about 150° to each other, so that the maximum water propulsion force can be exerted against water resistance concentrated at and directed towards the location under the bottom end of the shaft 12.

With reference to FIG. 2, the paddle 10 has an intermediate upwardly extending shaft 12, which at its upper end has a hollow, thickened portion 20 which is generally eliptical in transverse cross section presenting a forward ridge 22. A handle formation 14 is provided at the top of portion 20. The thickened upper portion 20 of the shaft 12 increases the buoyancy of the paddle. A hinge pin 24 extends transversely of the longitudinal axis of the shaft 12, on each side of the lower part of shaft 12. Two similar generally semi-circular plate members 16, 18 are provided in mutually opposed relationship, pivotally mounted on each side of the hinge pin 24.

At its lower end, the shaft 12 is received in a housing sleeve 26. The housing sleeve 26 is provided with opposed longitudinally extending slots 28, one at each side. The shaft 12 inside the housing sleeve 26 is provided with a longitudinal sliding collar 30. The upper end of collar 30 carries a coil spring 32, which is received at its upper end inside a tapered formation 34 at the upper end of the housing sleeve 26. The spring 32 urges the sleeve 30 downwardly and provides biasing means for the plates 16, 18 towards the open position. This is accomplished by the provision of hinged tie rods 36, 38 pivotally connected at their respective lower ends 40, 42 to the respective plates 16, 18. At their upper ends, the tie rods 36, 38 are pivotally connected by means of hinge formations 44 to the slidable collar 30, through the slots 28.

The upper end of the paddle 10 is provided with biased arm supporting means 46, described in more detail in my application Ser. No. 747,666, filed on even date herewith and the disclosure of which is incorporated herein by reference.

Figure 3:
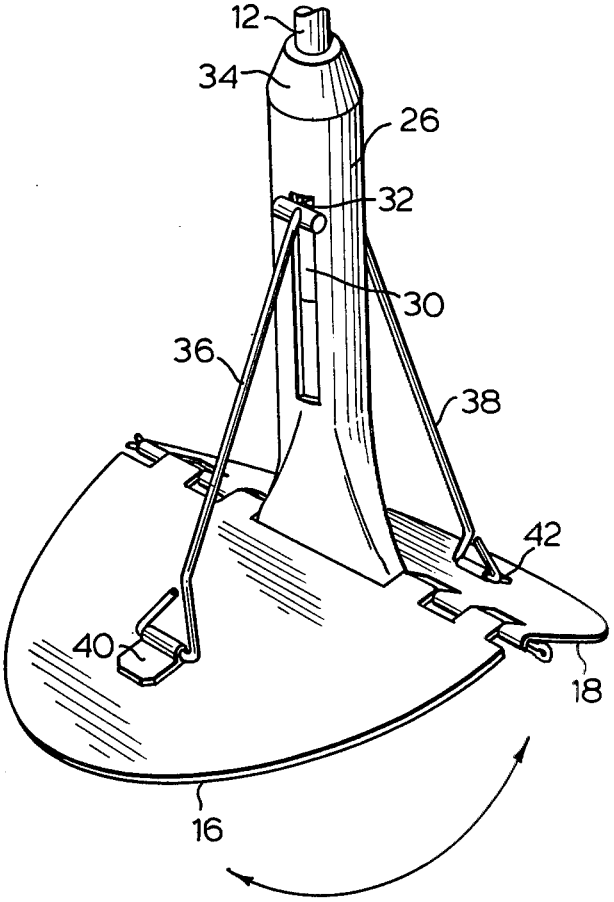
FIG. 3 is a perspective view of the bottom end of the paddle of FIG. 2, in the open position.

During the downward movement of a propulsion stroke, the bottom portion of the paddle 10 moves from the relative position of parts shown in FIG. 2 to the disposition shown in FIG. 3. The resistive force of the water causes the plates 16, 18 to separate and hinge about the hinge pin 24, taking up their opened, large surface presenting position shown in FIG. 3. In this movement, tie rods 36, 38 hinge at their bottom ends about pivotal connections 40, 42 to the respective plates, and about the upper hinges 44 by means of which they are connected to slidable collar 30 inside the housing sleeve 26. The collar 30 is thus moved upwardly inside the sleeve 26, about shaft 20, against the urging of compression spring 32 located inside housing sleeve 26. Thus the parts assume the position shown in FIG. 3. The upward travel of collar 30 within housing sleeve 26 is limited by full compression of the spring 32, so as to define and limit the fully open position of the plates 16, 18. When the downward propulsive force on the shaft 12 is stopped, and the paddle is withdrawn upwardly through the water, the plates 16, 18 collapse and return to the positions shown in FIG. 2, assisted by the urging of the coil spring 32 urging the collar 30 downwardly within the housing sleeve 26.

It will be appreciated that other arrangements and mechanisms for effecting desired action of the lower portion of the paddles can be adopted, within the scope of the present invention. The embodiments illustrated and described in detail are by way of example only, the scope of the invention being limited only by the appended claims.

What I claim is:

1. A water propulsion paddle for use in self-propelled water skiing including a lower water-engaging portion, a shaft extending upwardly from said water-engaging portion and a handle means adapted to be gripped by the operator's hand at the upper portion of the shaft;

the water-engaging portion comprising a pair of essentially similar flat plate members hingedly mounted on a hinge pin secured to and extending transversely to the axis of the shaft for mutually co-ordinated hinging movement of the plates between an open position in which the plate members make an angle from about 130° to about 170° between each other and a closed position in which the plate members define an angle of from about 10°–30° therebetween;

said hinge pin extending generally in a forward to rearward direction with respect to the direction of travel of the paddle when in operation;

and biasing means urging said plates towards their closed position.

2. The water propulsion paddle of claim 1, wherein the shaft includes at its upper end a hollow, thickened portion which is generally elliptical in transverse cross-section presenting a forward ridge extending in the forward direction.

3. The water propulsion paddle of claim 1 in which both of the water-engaging flat plate members are semi-circular, hingedly mounted on said hinge pin at a common diameter.

4. The water propulsion paddle of claim 1 further including:

a housing sleeve receiving the lower end of the shaft;

opposed elongated slots at the sides of the housing sleeve;

a collar slidable on the shaft within said housing sleeve;

a pair of hinged tie-rods, each associated with one of said flat plate members, the hinged tie-rods having upper portions protruding through respective elongated slots and hingedly secured to said slidable collar, and lower portions hingedly secured to said flat plate members;

said biasing means comprising a spring inside said housing sleeve acting on said slidable collar to urge the tie-rods downwardly and hence urge the plates towards their closed position.

* * * * *